United States Patent [19]

Aoyama

[11] Patent Number: 4,967,423

[45] Date of Patent: Nov. 6, 1990

[54] BIDET ATTACHMENT FOR TOILET BOWLS

[76] Inventor: Susumu Aoyama, 667-B Stafford Square, Winnipeg, Manitoba, Canada, R3M 2X7

[21] Appl. No.: 201,420

[22] Filed: Aug. 1, 1988

[30] Foreign Application Priority Data

Jun. 24, 1985 [CA] Canada ..... 485019

[51] Int. Cl.[5] ..... A47K 3/20

[52] U.S. Cl. ..... 4/420.4; 4/447; 239/588

[58] Field of Search ..... 4/420.1, 420.2, 420.4, 4/443, 444, 447, 420.3, 420.5, 445, 446, 448; 239/548, 588, 565

[56] References Cited

U.S. PATENT DOCUMENTS

| | | | |
|---|---|---|---|
| 1,724,161 | 8/1929 | Wuesthoff | 239/548 |
| 1,886,920 | 11/1932 | Thomas | 4/420.1 |
| 1,950,796 | 3/1934 | Hilgerink | 239/590.3 |
| 2,875,450 | 3/1959 | Umann | 4/420.2 |
| 3,015,826 | 1/1962 | Aranas | 4/420.4 |
| 3,154,793 | 11/1964 | Congdon | 4/420.2 |
| 3,423,029 | 1/1969 | Demaison | 239/565 |
| 3,430,267 | 3/1969 | Van Houten | 4/420.1 |
| 3,430,268 | 3/1969 | Zoberg | 4/420.1 |
| 3,550,863 | 11/1968 | McDermott | 239/565 |
| 3,577,567 | 5/1971 | Wintercorn | 4/445 |
| 4,028,745 | 6/1977 | Caniglia | 4/420.2 |
| 4,422,189 | 12/1983 | Couvrette | 4/443 |
| 4,441,219 | 4/1984 | Epstein | 4/448 |
| 4,597,111 | 7/1986 | Hirashiba et al. | 4/420.4 |
| 4,691,391 | 9/1987 | Kuo | 4/447 |

FOREIGN PATENT DOCUMENTS

| | | | |
|---|---|---|---|
| 763636 | 7/1967 | Canada . | |
| 366707 | 1/1921 | Fed. Rep. of Germany | 239/565 |
| 686962 | 3/1965 | Italy | 239/565 |

*Primary Examiner*—Henry J. Recla
*Assistant Examiner*—J. Casimer Jacyna
*Attorney, Agent, or Firm*—Murray E. Thrift; Stanley G. Ade; Adrian D. Battison

[57] ABSTRACT

A bidet attachment is provided for the underside of a toilet seat with selectively actuated outlets at the front and rear side thereof and connected to the hot and cold water pipes with control valves for temperature adjustment. The outlets comprise a plurality of small conduits bunched together and leading to the main conduits so that a spray head configuration is obtained. An air stream adjustable as to temperature may also be provided at the front and rear of the seat adjacent the water outlets, said air being provided by air conduits leading to a source of air under pressure.

12 Claims, 2 Drawing Sheets

BIDET ATTACHMENT FOR TOILET BOWLS

BACKGROUND OF THE INVENTION

This invention relates to new and useful improvements in bidet attachments to conventional toilet bowls or commodes.

Conventionally such devices are provided in a separate bowl, or alternatively, are built in during original manufacture.

SUMMARY OF THE INVENTION

The present invention overcomes these disadvantages by providing an attachment which can be secured to the underside of a conventional toilet seat in the space between the underside of the seat and the upper side of the bowl. It is easily attached to present plumbing and, if desired, can include a source of warm air under pressure for drying purposes.

In accordance with the invention there is provided a bidet attachment for toilets adapted to be situated under the seat between the under side of the seat and the upper side of the bowl; comprising in combination a rear water outlet and a front water outlet and control means connecting said outlets to a source of water under pressure, said outlets including a plurality of relatively small conduits bunched together to form a spray head, secured to the under side of the seat and directed towards the center of said bowl and slightly upwardly therefrom.

The plurality of relatively small tubes forming the spray head can be positioned as desired, particularly when the installation is taking place.

The control means for the rear water outlet and the front water outlet together may preferably be used to control the temperature of the water within limits and to control the discharge of water from either the front, or the rear or both locations.

Embodiments of the invention may also include a supply of air under pressure, which also may be temperature controlled within limits and which furthermore can discharge either at the rear of the bowl, the front of the bowl or both as desired.

With the foregoing in view, and other advantages as will become apparent to those skilled in the art to which this invention relates a this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 6:
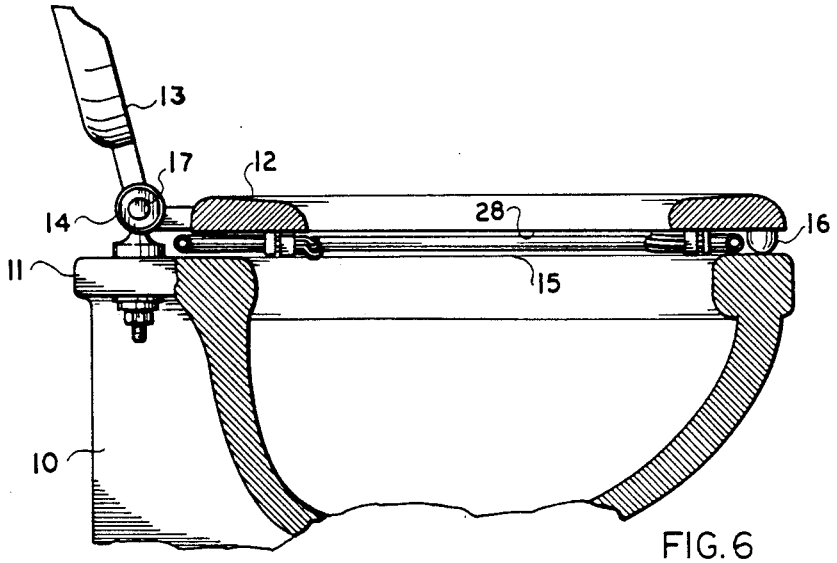
FIG. 6 is a fragmentary partially sectioned vertical elevation of a toilet bowl with the invention installed thereon.
Figure 5:
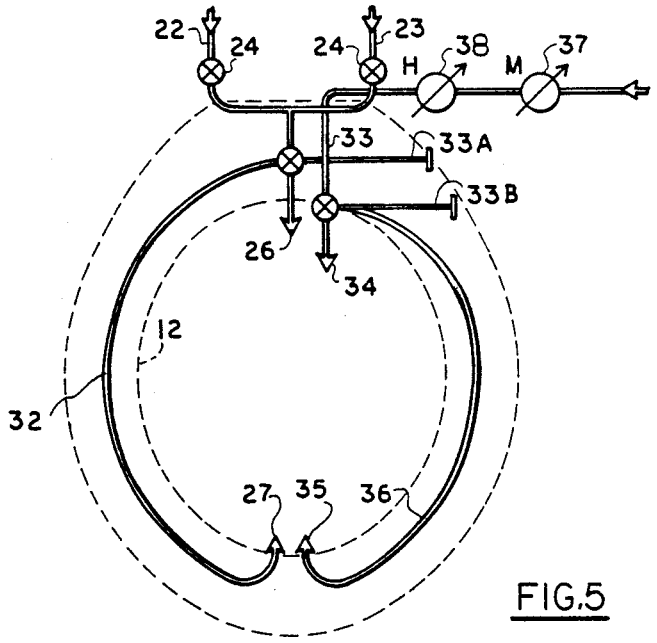
FIG. 5 is a schematic view showing one suggested routing of the air and water to the outlets.

Proceeding therefore to describe the invention in detail, reference should first be made to FIG. 6 in which 10 illustrates a conventional toilet bowl including the rear portion 11, the conventional toilet seat 12, and a cover 13 both of which are supported between trunions 14 on the upper surface of the rear portion 11 of the bowl all of which is conventional.

The seat is maintained spaced above the upper surface 15 of the bowl by means of front bumpers 16 with the location of the pivot pins 17 being spaced above the surface 15 so that the seat is substantially parallel when in the lowered position shown in FIG. 6.

The invention consists of a rear water discharge assembly collectively designated 18 and a front water discharge assembly collectively designed 19.

They both include main water conduits 20 leading to a cross conduit 21 which in turn is operatively connected to a source of hot water via conduit 22 and a source of cold water via conduit 23. Hand operated valves 24 are situated within these conduits and enable the user the adjust the quantity of hot and cold water so that the combined output can be controlled as to temperature, within limits.

Figure 1:
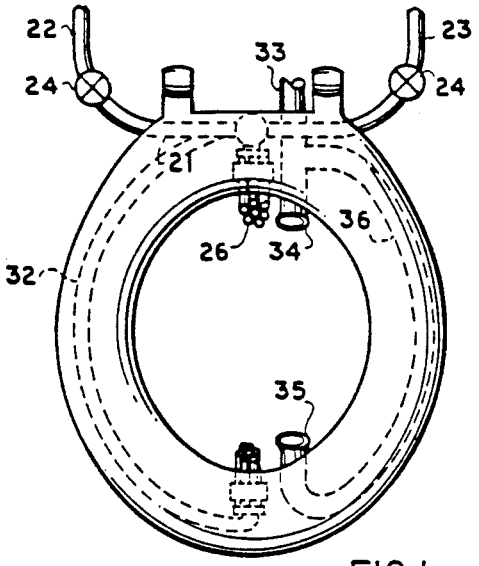
FIG. 1 is a top plan view of a toilet seat per se showing the device installed thereon.
Figure 2:
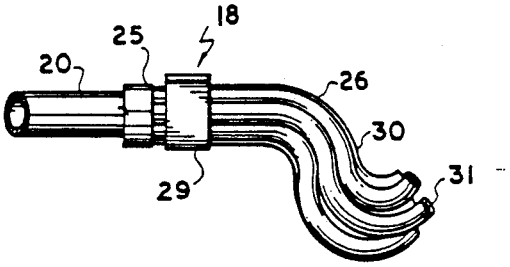
FIG. 2 is an enlarged side elevation of the rear water outlet.
Figure 3:
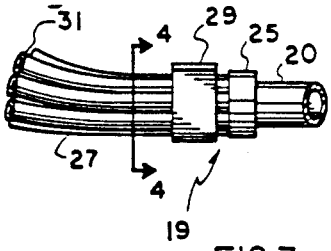
FIG. 3 is a view similar to FIG. 2 but showing the front water outlet.
Figure 4:
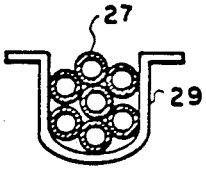
FIG. 4 is a cross sectional view along the line 4—4 of FIG. 3.

Each of the conduits 20 connect to a manifold 25 from which extends a plurality of relatively small bore pipes or conduits 26 and 27. These may be positioned as shown in FIG. 4 to form a spray discharge head and they are both secured to the underside surface 28 of the toilet seat 12 by means of U-clamps 29 fastened to the underside. In the case of the rear water outlet 18. the malleable pipes 26 are formed in an S-shaped configuration 30 with the discharge ends 31 directed towards the center of the bowl and slightly upwardly from the upper surface 15 thereof. The front water outlets are also secured to the underside of the seat by a similar clamp 29 and are directed also towards the center of the seat and incline upwardly terminating in the discharge ends 31 as shown in FIG. 2. The mallelability of these conduits 26 and 27 is such that the discharge angle can be adjusted slightly as desired.

A curved conduit 32 extends from the cross conduits 21, around one side of the seat on the under side thereof and connects to the manifold 25 of the front water outlet and a three-way valve 33A is situated so that the user can control the discharge of water either to the front water outlet 27 or to the rear water outlet 26 or both as desired.

An air conduit 33 may also be provided having a rear air outlet 34 and a front air outlet 35 connected by a curved conduit 36 extending around the underside of the seat on the opposite side to the water conduit 32. This may also include a three-way valve 33B which enables the user to direct air through the rear outlet 34, through the front outlet 35 or both as desired. The conduit 33 is connected via flexible hosing or the like to an adjustable heater element 38 over which air under pressure may be moved by an adjustable fan assembly 37 all of which is conventional.

It will therefore be seen that a relatively simple construction is provided which is easily retrofitted to existing toilet bowls and seats and which can easily be connected to the conventional hot and cold water systems of the bathroom with the warm air assembly also being readily secured if desired.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A bidet attachment for toilets adapted to be situated under the seat between the under side of the seat and the upper side of the bowl; comprising in combination a rear water outlet and a front water outlet and control means connecting said outlets to a source of water under pressure, said outlets including a plurality of relatively small, independent, tubular conduits bunched together to form a spray head, secured to the under side of the seat and directed towards the center of said bowl and slightly upwardly therefrom.

2. The attachment according to claim 1 which includes means to route said water to the front outlet, the rear outlet and both outlets selectively.

3. The attachment according to claim 2 in which said means to route said water includes a three-way valve.

4. The attachment according to claim 2 in which said source of water includes hot and cold water, said control means controlling the volume of hot and cold water flowing to said outlets thereby controlling the temperature thereof within limits.

5. The attachment according to claim 2 which includes a manifold at said rear water outlet and a further manifold at said front water outlet, said plurality of conduits being operatively connected to said manifold.

6. The attachment according to claim 3 in which said source of water includes hot and cold water, said control means controlling the volume of hot and cold water flowing to said outlets thereby controlling the temperature thereof within limits.

7. The attachment according to claim 3 which includes a manifold at said rear water outlet and a further manifold at said front water outlet, said plurality of conduits being operatively connected to said manifold.

8. The attachment according to claim 1, in which said source of water includes hot and cold water, said control means controlling the volume of hot and cold water flowing to said outlets thereby controlling the temperature thereof within limits.

9. The attachment according to claim 1 which includes an air outlet adjacent said rear water outlet and a further air outlet adjacent said front water outlet, said air outlets also being directed towards the center of the bowl and slightly upwardly therefrom and a source of air under pressure for said air outlets, and means to control the temperature of said air within limits.

10. The attachment according to claim 9 which includes means to route said air to the front air outlet, the rear air outlet and both air outlets selectively.

11. The attachment according to claim 10 in which said means to route said air under pressure consists of a three-way valve.

12. The attachment according to claim 1 which includes a manifold at said rear water outlet and a further manifold at said front water outlet, said plurality of conduits being operatively connected to said manifold.

* * * * *